US010660433B1

(12) United States Patent
Jomaa

(10) Patent No.: US 10,660,433 B1
(45) Date of Patent: May 26, 2020

(54) MODULAR SHELF ASSEMBLY

(71) Applicant: Mohammed Jomaa, Calgary (CA)

(72) Inventor: Mohammed Jomaa, Calgary (CA)

( * ) Notice: Subject to any disclaimer, the term of this patent is extended or adjusted under 35 U.S.C. 154(b) by 0 days.

(21) Appl. No.: 16/501,612

(22) Filed: May 9, 2019

(51) Int. Cl.
*A47B 47/00* (2006.01)
*A47B 47/02* (2006.01)
*A47B 57/40* (2006.01)

(52) U.S. Cl.
CPC ..... *A47B 47/0091* (2013.01); *A47B 47/0058* (2013.01); *A47B 47/028* (2013.01); *A47B 57/40* (2013.01)

(58) Field of Classification Search
CPC ... A47B 47/042; A47B 47/024; A47B 47/028; A47B 47/40; A47B 47/0058; A47B 47/0091; A47B 57/40; A47F 5/116
See application file for complete search history.

(56) References Cited

U.S. PATENT DOCUMENTS 2,152,192 A * 3/1939 Hoffman ..... A47F 7/08 211/34
3,039,619 A * 6/1962 Lyon ..... A47B 47/024 108/109
3,394,973 A * 7/1968 Scott ..... A47F 5/103 312/262
3,464,565 A * 9/1969 Nevai ..... A47B 65/00 211/42
3,534,863 A * 10/1970 Howard ..... A47F 7/163 211/47
3,549,019 A * 12/1970 Kahler ..... A47F 5/116 211/135
3,888,353 A * 6/1975 Leifheit ..... A47B 61/04 211/37
4,282,977 A * 8/1981 Di Lorenzo ..... F16B 12/18 211/189
4,646,923 A * 3/1987 Winter ..... A47F 5/083 211/189
4,730,740 A * 3/1988 Winter ..... A47F 5/083 211/189
6,257,420 B1 * 7/2001 Dardashti ..... G11B 23/0236 211/189
6,321,918 B1 * 11/2001 Rollins ..... A47B 87/0207 211/194
D475,554 S * 6/2003 Ming-Shiue ..... D6/675
6,729,481 B1 * 5/2004 O'Brien ..... A47B 73/00 211/74
2004/0069733 A1 * 4/2004 Leclerc ..... A47B 47/021 211/187
2005/0103735 A1 * 5/2005 Paventi ..... A47F 5/00 211/189

FOREIGN PATENT DOCUMENTS

GB 212156 A * 3/1924 ..... A47B 47/025
GB 342048 A * 1/1931 ..... A47B 57/40

* cited by examiner

*Primary Examiner* — Kimberley S Wright
(74) *Attorney, Agent, or Firm* — Cassan Maclean IP Agency Inc.

(57) ABSTRACT

A modular shelf assembly includes planar panels for defining the sides of the assembly, and elongated vertical rows of slots in the panels for receiving the hooked ends of shelf supporting rods, and planar crossbars and diagonal braces with hooked ends for releasably latching the panels together in parallel, spaced apart relationship to each other.

4 Claims, 4 Drawing Sheets

MODULAR SHELF ASSEMBLY

FIELD OF THE INVENTION

This invention relates to a modular shelf assembly and in particular to a modular to a modular, metal shelf assembly.

BACKGROUND OF THE INVENTION

Metal shelves are commonly used for storing goods in various locations such as wholesale and retails stores, warehouses and factories. Modular metal shelf systems are by no means new. A variety of such shelves are commercially available. The modular shelves consist of prefabricated components which are shipped from factories and assembled on site. The shelves typically include a variety of elements such as posts and crossbars, which are fastened together on site. One such shelving system is described in Canadian Patent No. 1,171,389, which issued to Wallace T. Husband on Jul. 24, 1984. The Husband system includes a plurality of elements produced by bending and stamping pieces of metal.

An object of the present invention is to provide a simple modular shelving assembly, which consists of relatively few planar elements, all of which are produced as single, planar pieces without bending.

SUMMARY OF THE INVENTION

In accordance with one aspect, the invention is a modular shelf assembly comprising:

a plurality of planar panels for defining sides of the shelf assembly, each panel including a first vertical row of spaced apart slots proximate one side edge of the panel;

a second vertical row of spaced apart slots parallel to and spaced apart from said first row of slots;

a third vertical row of spaced apart slots parallel to and spaced apart from said second row of slots, the third row of slots being closer to a second side of the panel than the second row of slots;

shelf supporting rods for extending between and into horizontally aligned slots in the first row of slots in a pair of spaced apart panels, and between and into horizontally aligned slots in second rows of slots in the pair of spaced apart panels, notches proximate the ends of the rods for receiving bottom edges of said slots, whereby the spacing between the pair of panels is maintained and the panels remain parallel to each other;

crossbars for extending between the pair of panels and partially through horizontally aligned third slots in the pair of panels, and hooks on the ends of said crossbars for releasably latching the pair of panels together in parallel, spaced apart relationship to each other; and braces for extending diagonally between the pair of panels and partially through vertically spaced apart third slots in the pair of panels, and hooks on the ends of said braces for further releasably latching the pair of panels together.

This invention is described below in greater detail with reference to the accompanying drawings, which illustrate preferred embodiments of the invention.

DETAILED DESCRIPTION OF THE INVENTION

Figure 1:
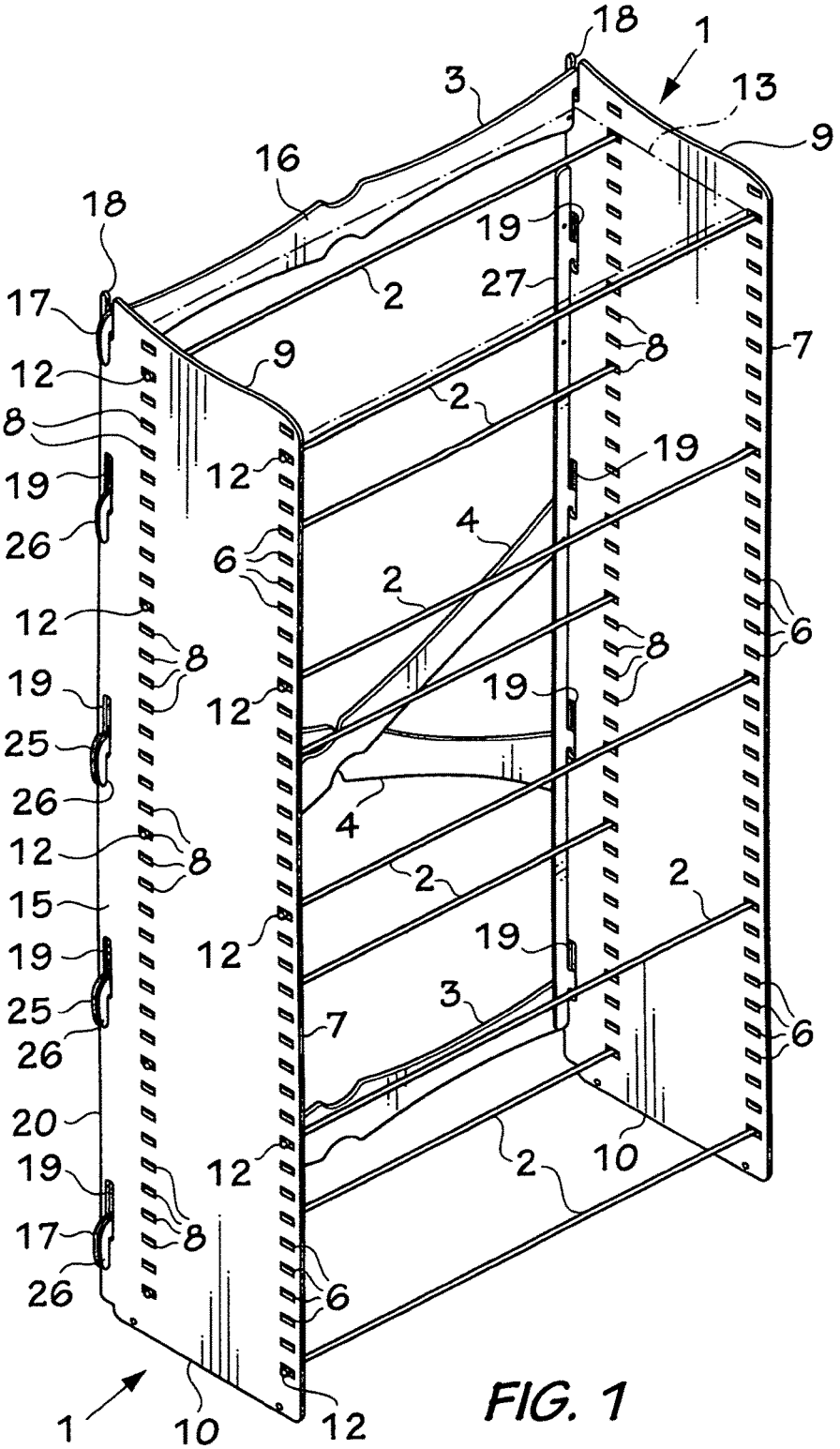
FIG. 1 is an isometric view of one embodiment of a modular shelf assembly in accordance with the present invention.
Figure 5:
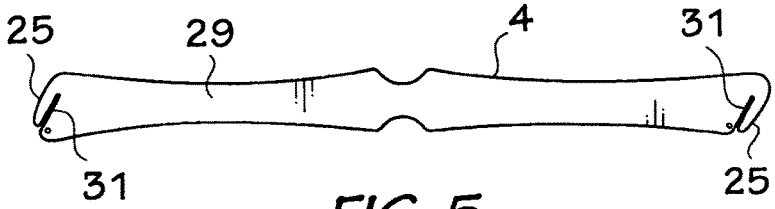
FIG. 5 is a front view of a diagonal brace used in the shelf assembly of FIG. 1.

With reference to FIGS. 1 to 5, the basic elements of the modular shelf assembly include a panel indicted generally at 1 (FIGS. 1 and 2), a rod 2 (FIGS. 1 and 3), a horizontal crossbar (FIGS. 1 and 4) and a diagonal brace 4 (FIGS. 1 and 5).

Figure 2:
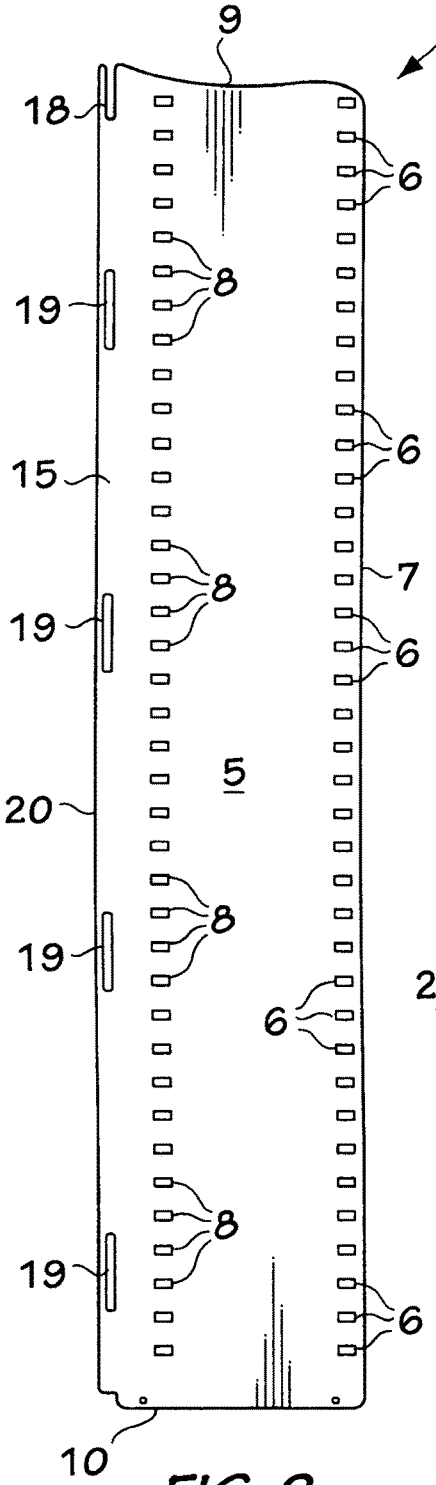
FIG. 2 is a side view of a panel used in the shelf assembly of FIG. 1.

As best shown in FIG. 2, each panel 1 is defined by a planar body 5 containing a first vertical row of slots 6 proximate a front edge 7 thereof, and a second vertical row of slots 8 spaced apart from the first row of slots 6. The rows of slots 6 and 8 extend from close to the top edge 9 to close to the bottom edge 10 of the panel 1. The slots 6 and 8 receive the ends 12 of the rods 2 for supporting shelves 13 (one shown in FIG. 1) and for maintaining the front ends of adjacent panels 1 in parallel, spaced apart relationship to each other. For such purposes, annular grooves 14 (FIG. 3) are provided proximate the ends 12 of the rods 2.

Figure 3:
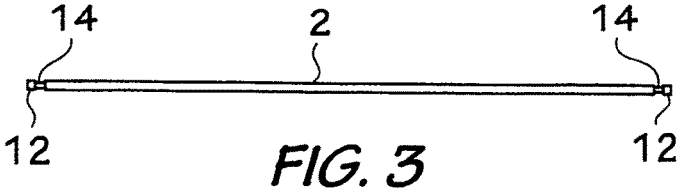
FIG. 3 is a front view of a rod used in the shelf assembly of FIG. 1.
Figure 4:
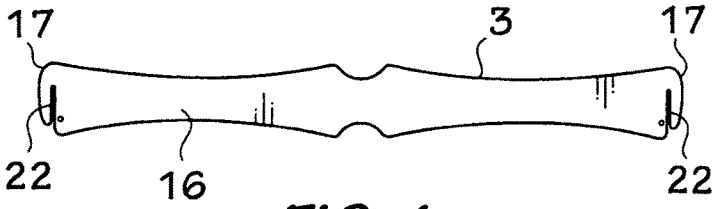
FIG. 4 is a front view of a crossbar used in the shelf assembly of FIG. 1.

The rear ends 15 of adjacent panels 1 are connected together in spaced apart relationship to each other by the crossbars 3 and the diagonal braces 4. Referring to FIG. 3, the crossbar 3 includes a planar body 16 with slightly convex, hooked ends 17, which facilitate insertion of the ends into a notch 18 in the top edge 9 and a slot 19 proximate the bottom rear edge 20 of the panel body 5. Vertical notches 22 are provided in the bottom of the ends 17 of the crossbars 3. When the ends 17 are placed in the notches 18 or the slots 19 and downward pressure is applied, the hooked ends 17 slide downwardly to latch the crossbars 3 to the panels 1.

Figure 6:
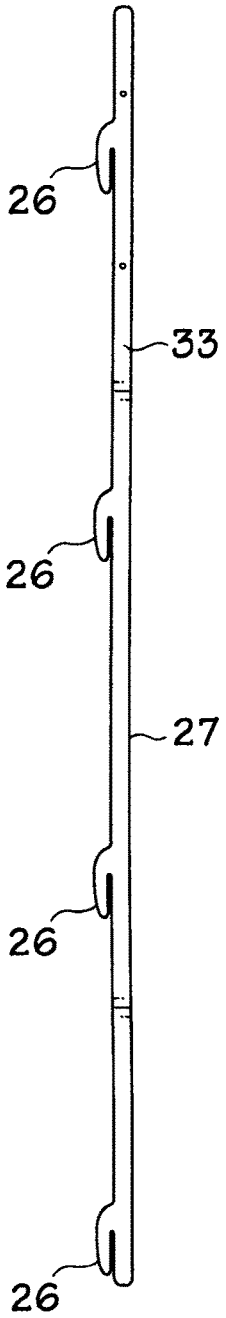
FIG. 6, which appears on the first sheet of drawings, is a front or rear view of a backstop used in the shelf assembly of FIG. 1.

The notch 18 and the slot 19 are vertically aligned with additional slots 19 which receive the hooked ends 25 of the diagonal braces 4 and hooks 26 (FIG. 6) on shelf backstops 27. Each inclined brace 4 (FIG. 5) is defined by a thin, planar body 29 with convex ends 25. Because the braces 4 are inclined in a shelf assembly, the braces 4 are longer than the crossbars 3. The ends 25 of the braces 4 are also convex which facilitate insertion of the ends into the slots 19 in the panels 1. The ends 25 of the braces 4 are inclined with respect to the longitudinal axis of the body 29, and notches 31 are provided in the bottoms of such ends. The result is the hooked ends 25, which are used to latch the braces 4 to a pair of panels 1 with the same spacing between the panels as achieved with the rods 2 and the crossbars 3. As best shown in FIG. 6, the backstops 27 are defined by narrow, planar strips 33 of metal with the hooks 26 extending outwardly from one side thereof.

Figure 7:
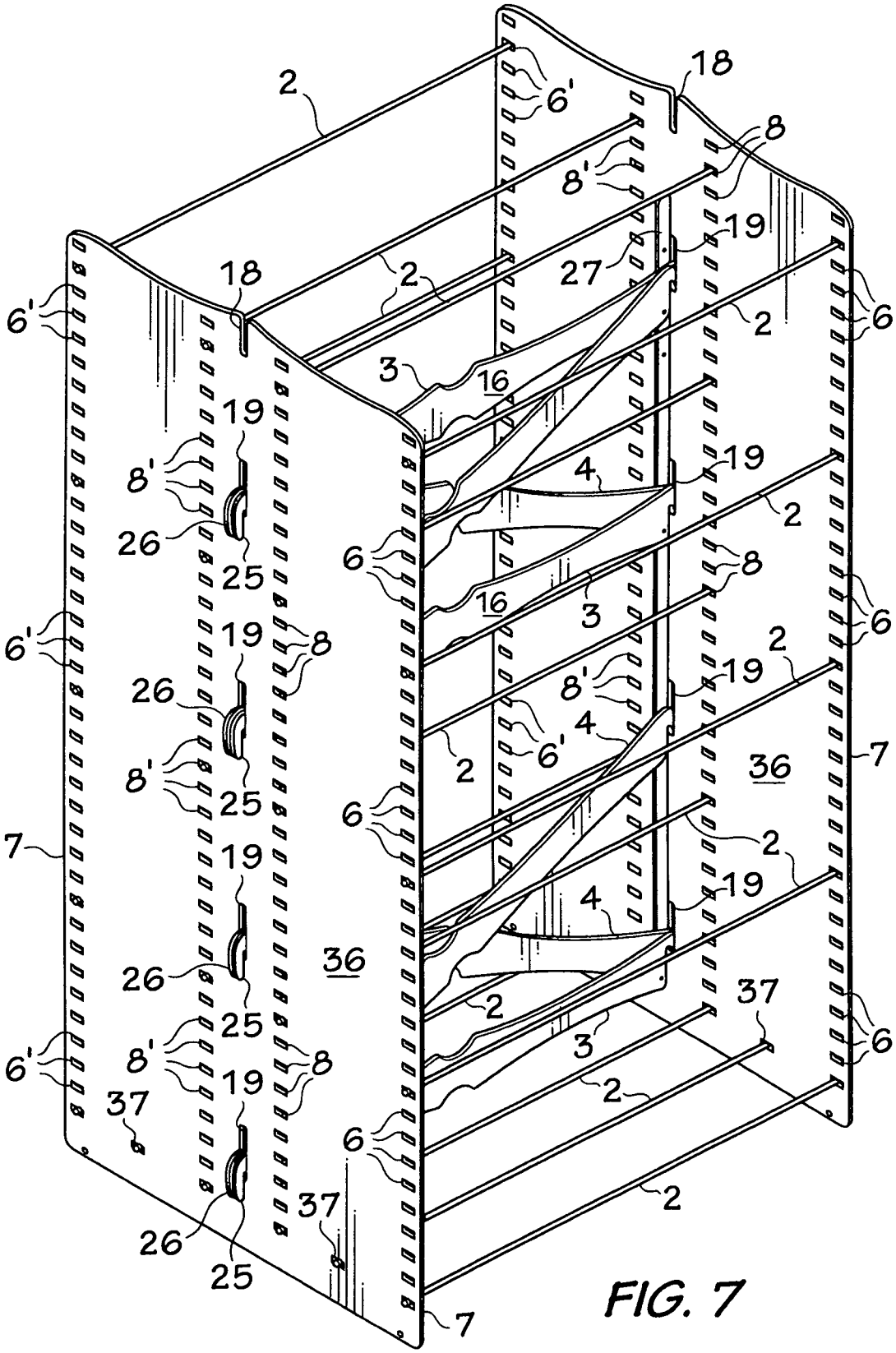
FIG. 7 is an isometric view of a second embodiment of the shelf assembly.
Figure 8:
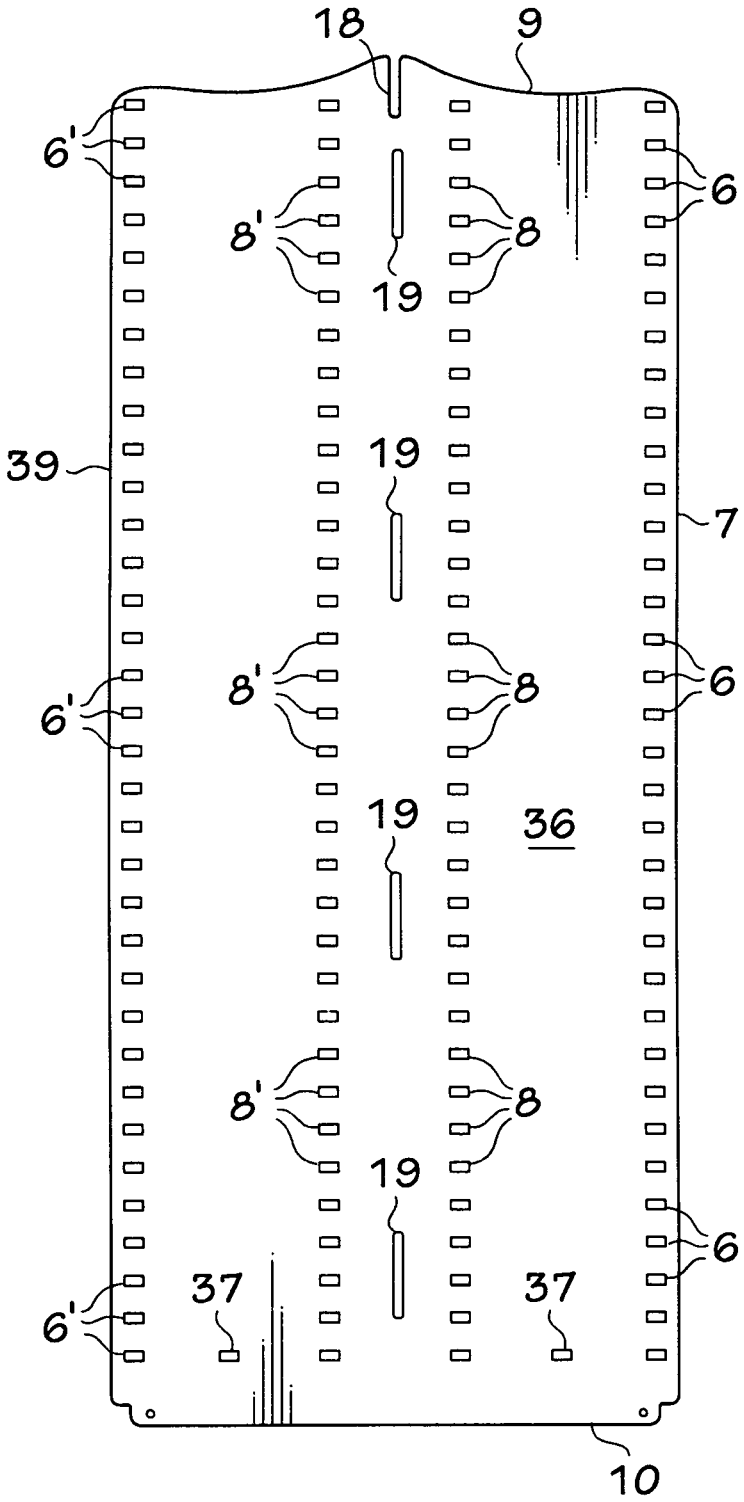
FIG. 8 is a side view of a panel used in the shelf assembly of FIG. 7.

Referring to FIGS. 7 and 8, a second embodiment of the invention provides an assembly for supporting two sets of shelves in back-to-back relationship to each other. Wherever possible reference numbers used to identify elements in FIGS. 1 to 6 have been used to identify the same or similar elements FIGS. 7 and 8 of the drawings. The second embodiment of the invention includes a panel 36, which is slightly less than twice the width of the single shelves panel 5. In the assembly of FIG. 7, a fourth vertical row of first slots 6' is provided adjacent the rear edge 37 of the panel 36. Obviously both edges 7 and 37 of the panel 36 can be considered to be front or rear edges depending upon the position of the observer with respect to the assembly. A notch 18 and the third row of slots 19 are located at the center of the panel 36, and a fifth vertical row of slots 8' is provided between the row of slots 6' and the third row of slots 19. As is the case with the slots 6 and 8, the slots 6' and 8' are adapted to receive the ends of shelf supporting rods 2. Additional crossbars 3 and braces 4 interconnected pairs of panels 1 and provide structural rigidity to the assembly.

Additional slots 39 are provided close to the bottom edge 10 of the panel 36 between the slots 6 and 8, and between the slots 6' and 8' for receiving additional self supporting rods 2.

The invention claimed is:

1. A modular shelf assembly comprising:

a pair of planar panels for defining sides of the shelf assembly, each panel including a first vertical row of spaced apart slots extending through the panel proximate one side edge of the panel;

a second vertical row of spaced apart slots extending through the panel parallel to and spaced apart from said first row of slots;

a third vertical row of spaced apart slots extending through the panel parallel to and spaced apart from said second row of slots, the third row of slots being closer to a second side of the panel than the second row of slots;

shelf supporting rods for extending between and into horizontally aligned slots in the first row of slots in said pair of spaced apart panels, and between and into horizontally aligned slots in second rows of slots in the pair of spaced apart panels, notches proximate the ends of the rods for receiving bottom edges of said slots, whereby the spacing between the pair of panels is maintained and the panels remain parallel to each other;

a plurality of crossbars for extending between the pair of panels and partially through horizontally aligned third slots in the pair of panels, and hooks on the ends of said crossbars for releasably latching the pair of panels together in parallel, spaced apart relationship to each other; and a plurality of braces for extending diagonally between the pair of panels and partially through vertically spaced apart third slots in the pair of panels, and hooks on the ends of said braces for further releasably latching the pair of panels together.

2. The modular shelf assembly of claim 1 including a shelf backstop for attachment to opposed sides of said pair of spaced apart panels for limited movement of shelves into the area between the pair of spaced apart panels.

3. The modular shelf assembly of claim 2, wherein said backstop includes an elongated, narrow strip of metal, and a plurality of hooks extending out of one side of said strip for hooking into slots in said third vertical row of slots.

4. The modular shelf assembly of claim 1, including a fourth vertical row of spaced apart slots proximate a second side edge of each said panel for receiving the ends of said shelf supporting rods; and a fifth vertical row of spaced apart slots between said third and fourth rows of slots for receiving ends of said shelf supporting rods, whereby sets of shelves can be mounted on the rods in back to back relationship to each other.

* * * * *